US006404114B1

(12) United States Patent
Jeavons

(10) Patent No.: US 6,404,114 B1
(45) Date of Patent: Jun. 11, 2002

(54) IMAGING SYSTEM USING A HIGH-DENSITY AVALANCHE CHAMBER CONVERTER

(75) Inventor: Alan Paul Jeavons, Oxford (GB)

(73) Assignee: Oxford Positron Systems Ltd., Oxford (GB)

( * ) Notice: Subject to any disclaimer, the term of this patent is extended or adjusted under 35 U.S.C. 154(b) by 0 days.

(21) Appl. No.: 09/446,361

(22) PCT Filed: Jun. 19, 1998

(86) PCT No.: PCT/GB98/01816

§ 371 (c)(1),
(2), (4) Date: Mar. 14, 2000

(87) PCT Pub. No.: WO98/59262

PCT Pub. Date: Dec. 30, 1998

(30) Foreign Application Priority Data

Jun. 20, 1997 (GB) ..... 9712927

(51) Int. Cl.[7] ..... H01J 61/30
(52) U.S. Cl. ..... 313/346 R; 313/491; 313/632
(58) Field of Search ..... 313/346 R, 491, 313/632, 631, 93; 250/385.1, 374, 207, 214 VT, 214.1

(56) References Cited

U.S. PATENT DOCUMENTS 5,434,468 A * 7/1995 Jeavons ..... 313/346 R

* cited by examiner

*Primary Examiner*—Vip Patel
*Assistant Examiner*—Ken A Berck
(74) *Attorney, Agent, or Firm*—Fleshner & Kim, LLP

(57) ABSTRACT

An imaging system module comprising: a pair of high density avalanche chamber converters (11, 12) each including alternate layers (15, 16) of conducting and non-conducting material and an array of holes (17) extending through the alternate layers (15, 16), the first converter (11) having conducting elements (18) extending parallel to each other to form a first cathode on or adjacent to a face of the converter (11) and the second converter (11) having conducting elements (19) extending parallel to each other in a direction orthogonal to the conducting elements (18) to form a second cathode on or adjacent to a face of the second converter (12), and an anode (21) formed by parallel conducting elements between the first and second cathodes (18, 19). Radiation incident upon either converter (11, 12) produces an avalanche of charged particles which are attracted towards the anode (21) and the incidence of a charged particle on the anode (21) causes a current pulse in both the first and second cathodes (18, 19).

12 Claims, 3 Drawing Sheets

IMAGING SYSTEM USING A HIGH-DENSITY AVALANCHE CHAMBER CONVERTER

TECHNICAL FIELD

This invention relates to an imaging system module comprising high density avalanche chamber (HIDAC) converters and in particular to an imaging system for use in positron emission tomography (PET).

BACKGROUND ART

It is known to provide a HIDAC for use in PET. IEEE Tran. Nucl. Sci. NS30 640 (1983) describes the construction of one such form of HIDAC. U.S. Pat. No. 5,434,468 also discloses a HIDAC for use in imaging of beta radiation.

The HIDAC of U.S. Pat. No. 5,434,436 includes a gas tight, radiation transparent enclosure that may be filled with an inert gas during sampling. The incidence of beta radiation on the inert perforations of the converter ionizes the gas. Products of the ionization (typically electrons) are avalanched in the perforations and extracted towards the planar anode by high biasing voltages applied to the converter. Contact with the anode causes further avalanching and current pulses in the x- and y-axis components of the cathodes. Analysis of the cathode currents by signal processing circuits enables imaging of the radiation source.

In addition to the foregoing, it is known to provide a modified form of HIDAC suitable for imaging of gamma radiation sources. Such a HIDAC includes lead, which is stimulated to emit photoelectrons when subjected to gamma radiation, in order to compensate for the inability of gamma radiation directly to ionise the inert gas.

It is also known to provide a stack of converters of the types described above to increase the detection efficiency.

Although the apparatus described above has provided significant advances in the field of radiation imaging there remains a need for more efficient apparatus and particularly for apparatus which provides a reduction in the time taken to form an image.

DISCLOSURE OF INVENTION

According to a first aspect of the invention, there is provided an imaging system module comprising: a pair of high density avalanche chamber converters, each converter including a series of alternate layers of conducting and non-conducting material and an array of parallel, through-going apertures extending through said series of alternate layers, a first converter of the pair having a plurality of conducting elements extending generally parallel to each other in a first direction to form a first cathode on or adjacent to a face of the first converter and the second converter of the pair having a plurality of conducting elements extending generally parallel to each other in a direction generally orthogonal to the first direction to form a second cathode on or adjacent to a face of the second converter, and an anode formed by a series of generally parallel conducting elements positioned between the first and second cathodes, the arrangement being such that radiation incident upon either converter produces an avalanche of charged particles which are attracted towards the said anode and the incidence of a charged particle on the anode causes a current pulse in both the first and second cathodes.

According to a second aspect of the invention, there is provided an imaging system comprising a pair of detectors, each comprising a module as detailed above, the detectors being positioned opposite each other so that a radiation source of which an image is to be formed can be positioned therebetween.

According to another aspect of the invention there is provided PET apparatus incorporating one or more imaging system modules or an imaging system as described above.

Other preferred and optional features of the invention will be apparent from the following description and from the subsidiary claims of the specification.

BRIEF DESCRIPTION OF DRAWINGS

There now follows a description of a preferred embodiment of the invention, merely by way of example, with reference being made to the accompanying drawings in which:

Referring to FIG. 1, there is shown an imaging system module 10

BEST MODE OF CARRYING OUT THE INVENTION

Figure 1:
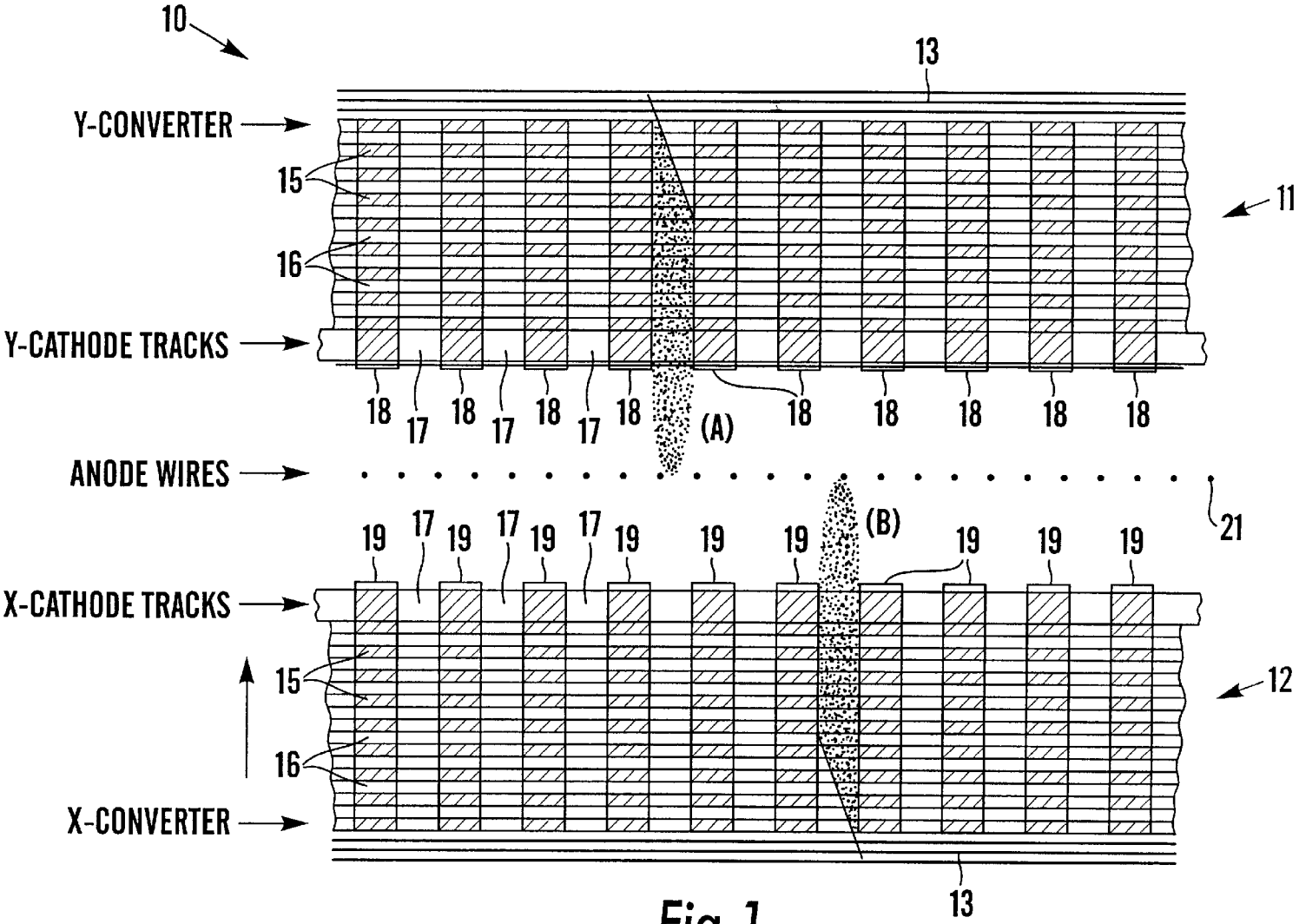
FIG. 1 is a schematic, cross-sectional view of part of an embodiment of an imaging system module according to the invention.

The module 10 includes two HIDAC converters 11 and 12. Each converter 11, 12 includes an outer membrane shown schematically at 13 that is gas-tight but transparent to the incident radiation. In practice, the membranes sealingly enclose the region where sampling occurs. Each membrane 13 is shown lying on the outermost face of the associated converter 11, 12. It will be appreciated that other sealing arrangements are possible. It is not essential for the membranes or functionally equivalent members to be secured to the converters 11, 12 as shown. The principal requirement is to permit flow of an inert gas about the converter s in an enclosed environment.

Inboard of the membrane 13, each converter 11, 12 includes a series of alternate layers 15 of lead interposed with further, similar layers 16 of a non-conducting material such as fibreglass.

Each converter also includes an array of parallel, through-going apertures 17 extending through said series of alternate layers 15, 16.

The face of each converter 11, 12 remote from the associated membrane 13 carries a series of mutually parallel, conducting tracks 18. The tracks 18 carried by converter 11 extend in a direction suitable for determining the y-axis component of the position of a radiation source; and the tracks 19 carried by the converter 12 extend in a n orthogonal direction in order to permit identification of the x-axis component thereof. The through-going apertures 17 also extend through the respective series of conducting tracks 18, 19.

The faces of the converters 11, 12 carrying the conducting tracks 18, 19 lie in close juxtaposition to one another, but spaced apart by a predetermined distance.

A planar anode 21 in the form of a series of mutually parallel conducting wires extends parallel to the aforesaid faces of converters 11, 12 in the region therebetween. The planar anode 21 is equi-spaced from the respective converters 11, 12. Other forms of anode may also be used, e.g. a series of parallel conductor strips on a base as used for microstrip and microgap chambers.

The conducting tracks 18, 19 serve as cathodes, tracks 18 serving as the y-cathodes and tracks 19 serving as the x-cathodes. The conducting tracks of the respective sets 18, 19 are conductingly connected together in a per se known manner (not shown in FIG. 1) in order, effectively, to provide cathodes on each side of the planar anode 21.

The conducting tracks 18, 19 may be provided on the said faces of the converters 11, 12 or adjacent thereto.

A circuit (not shown) is provided for applying a high biasing voltage (suitable magnitudes of which will be apparent to those skilled in the art) to the conducting lead plates 15. Means for introducing an inert gas into the HIDAC and subsequently expelling it therefrom after sampling has occurred are also provided.

In use of the apparatus, a volume of inert gas is introduced into the module 10, with the membranes 13 acting as gas-impermeable boundaries in order to contain the gas within the HIDAC. Gamma radiation incident on one or other of the converters 11, 12 stimulates photoelectron emission from the lead plates, and this in turn ionises the inert gas. The biasing voltage applied to the lead plates multiplies and extracts charged particles produced by the ionisation from the apertures 17 towards the planar anode 21.

When the charged particles reach the wires of the anode 21, a well-known avalanche effect occurs, causing a current pulse in both of the cathodes 18 and 19.

In order to maintain the high spatial resolution at all angles of incidence of the impinging radiation, it is necessary to determine which converter an avalanche event originates in. Signal processing means is, therefore, provided to compare the signals from the two cathodes 18, 19. If the event originates from converter 11 (as illustrated schematically at A) the avalanche development is biased towards the y-cathode and the y-pulse is always bigger than the x-pulse. Conversely, if the event originates from the converter 12 (as illustrated schematically at B) the x-pulse is always bigger than the y-pulse. The signal processing means may comprise a personal computer 24 (see FIG. 2) which is arranged to compare the pulse heights of signals on the two cathodes 18 and 19, e.g. by testing the value of the pulse height y divided by the pulse height x, to determine in which converter the avalanche originated. Further signal processing techniques may then be employed as known in the art to generate images from the data recorded.

Figure 3:
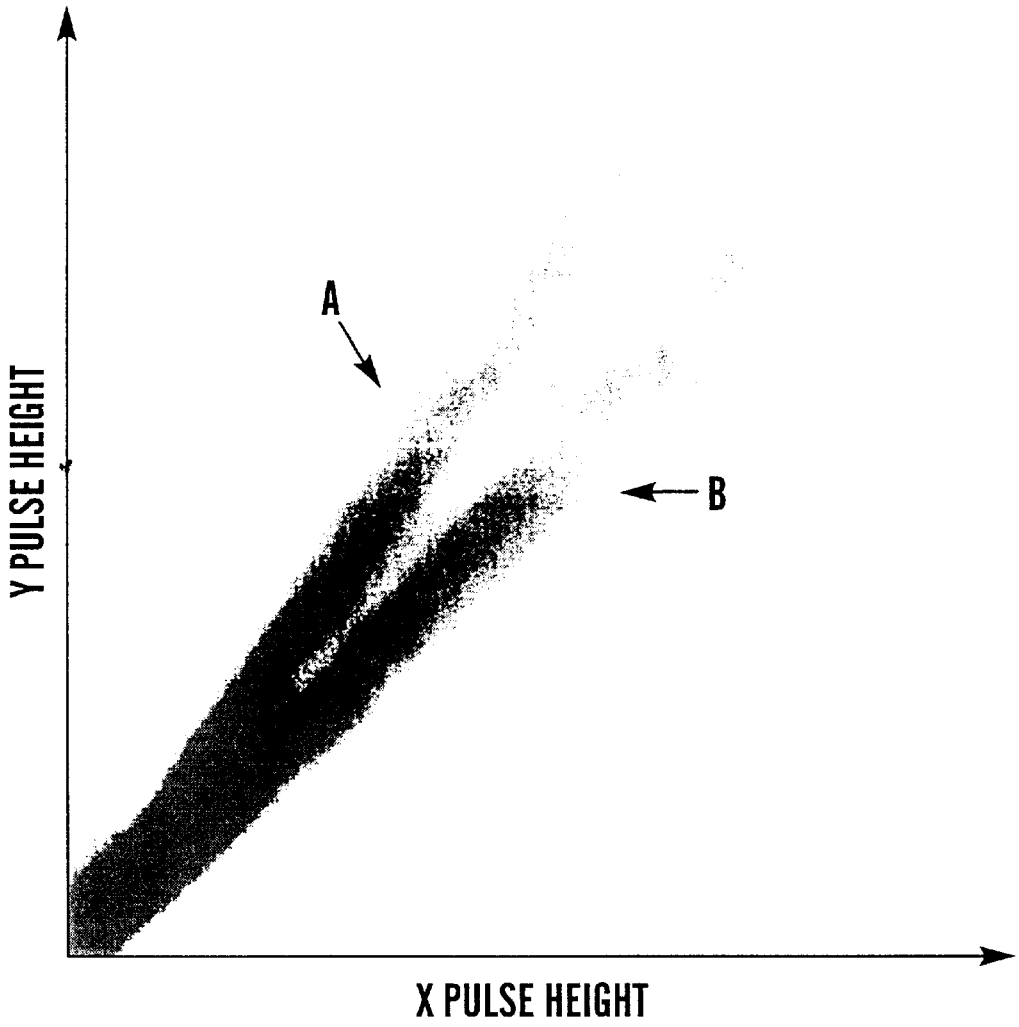
FIG. 3 is a graph showing a typical plot of pulse heights in one cathode against pulse heights in the other cathode.

FIG. 3 shows a typical plot of pulse heights y against pulse heights x and graphically illustrates the two classes of event—those originating in the converter 11 fall within the band labelled A and those originating in the converter 12 fall within the band labelled B.

As described above the imaging system module comprises two converters 11, 12 with cathodes 18, 19 provided thereon and a single anode 21 provided therebetween. Such an arrangement enables the module 10 to be made very compact compared to the prior art. Each of the converters 11, 12 may typically have a thickness of around 3 mm and the spacing between each of the cathodes 18, 19 and the anode 21 may also typically be around 3mm. Thus, the converters comprise approximately 50% of the thickness of the module 10. This is a significant improvement compared with the prior art (in which the converters only comprised about 20–25% of the thickness of the system). This significant reduction in thickness of the system enables the converters to be positioned closer to the sample and approximately twice as many converters to be packed into a given volume and so provides significant improvement in the detection efficiency.

Modules such as that shown in FIG. 1 may be stacked one upon another several times over to increase the detection efficiency. As mentioned above, such a construction has been found to be advantageously economical, as (because two converters are used in each module without any or any significant increase in the thickness of the module) twice as many converters can be provided on each side of the radiating object (target) than previously possible. This in turn leads to a quadrupling of event rate detection as compared with the arrangement described in U.S. Pat. No. 5,434,468.

A quadrupling of the detection rate enables the imaging time to be reduced by a factor of four, e.g. down from 1 hour to 15 minutes. This is of significant importance as it makes it feasible to use the system on live samples, and in particular on a human patient, which have previously been excluded due to the difficulty of keeping the subject still for the required length of time to form an image.

Furthermore, the elimination of the inactive base plate material associated with the converter in the arrangement of U.S. Pat. No. 5,434,468 reduces the gamma, scattering and background noise from within the detector.

Figure 2:
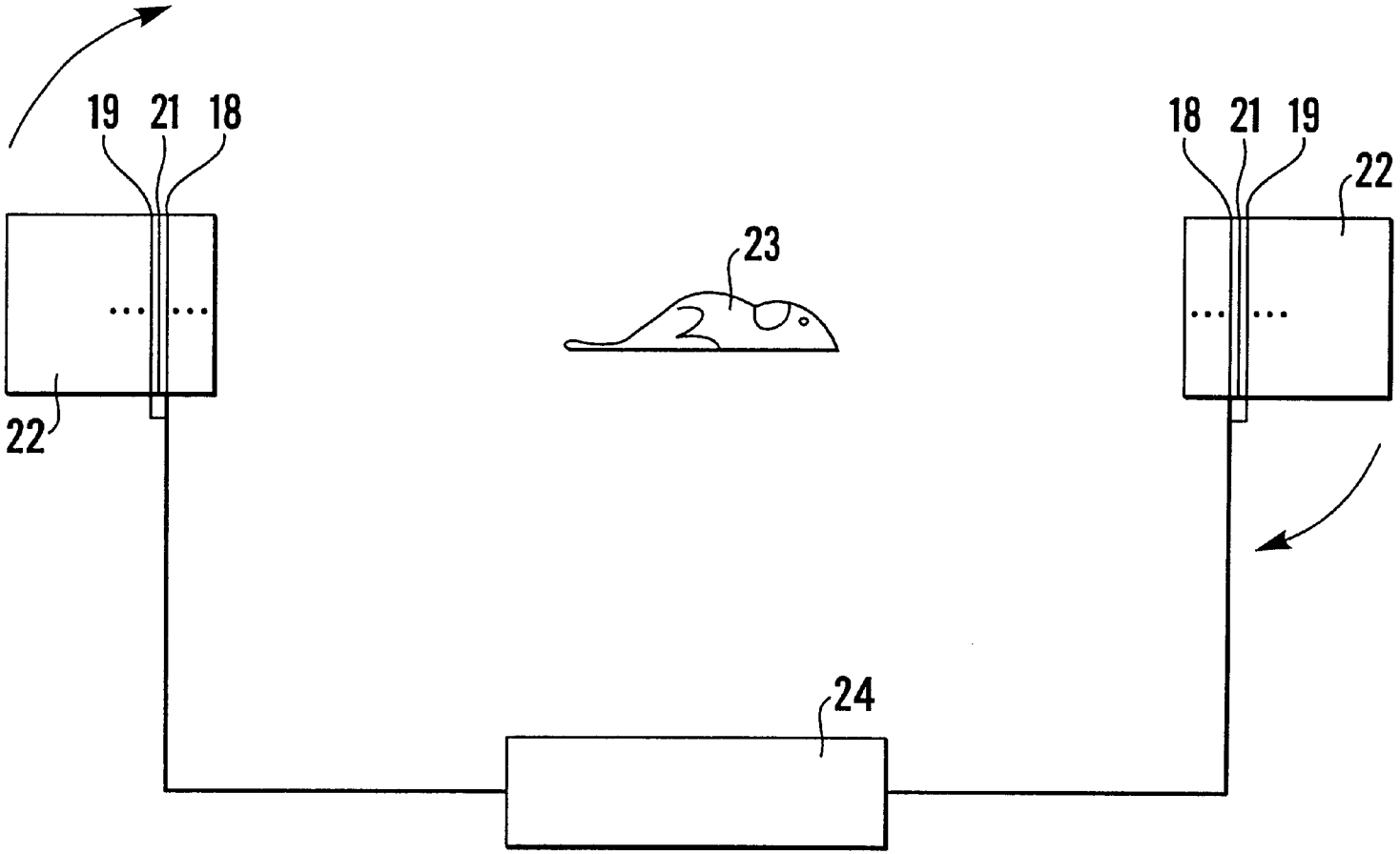
FIG. 2 is a schematic diagram of PET apparatus incorporating two imaging system modules as shown in FIG. 1.

The module described above can be used in an imaging system as shown in FIG. 2. The system comprises a pair of detectors 22 positioned on opposite sides of a radiation source 23 to be imaged. Each detector comprises at least one module 10 of the type described above. Rotation means (not shown) are also preferably provide for rotating the detectors 22 about the source 23.

A plurality of pairs of detectors 22 may be provided angularly displaced from each other so as to form a polygonal arrangement of detectors around the source 23.

Each detector 22 may, as mentioned above, comprise a stack of the modules 10, as many as twelve or sixteen modules may be provided in each stack.

The arrangement shown in FIG. 2 can be used in positron emission tomography.

Although it is expected that the majority of embodiments will be constructed including a photoelectron emitting material such as lead, in order to permit imaging of gamma sources, embodiments of the invention may also be manufactured in a simple form suitable for imaging of beta radiation sources.

The known techniques of rotating HIDAC chambers about a target source, of arranging a plurality of HIDACs in a polygonal pattern about a target, as shown in FIG. 2, and of stacking a plurality of such chambers, may also be employed using the apparatus described above.

What is claimed is:

1. An imaging system module comprising: a pair of high density avalanche chamber converters, each converter including a series of alternate layers of conducting and non-conducting material and an array of parallel, through-going apertures extending through said series of alternate layers, a first converter of the pair having a plurality of conducting elements extending generally parallel to each other in a first direction to form a first cathode on or adjacent to a face of the first converter and the second converter of the pair having a plurality of conducting elements extending generally parallel to each other in a direction generally orthogonal to the first direction to form a second cathode on or adjacent to a face of the second converter, and an anode formed by a series of generally parallel conducting elements positioned between the first and second cathodes, the arrangement being such that radiation incident upon either converter produces an avalanche of charged particles which are attracted towards the said anode and the incidence of a charged particle on the anode causes a current pulse in both the first and second cathodes.

2. An imaging system module as claimed in claim 1 comprising signal processing means for detecting said current pulses and comparing signals from the first and second cathodes to determine in which converter an avalanche originated.

3. An imaging system module as claimed in claim 2 in which the signal processing means is arranged to determine the ratio of pulse heights of signals on the two cathodes to determine in which converter the avalanche originated.

4. An imaging system module as claimed in claim 2 or 3 in which the signal processing means comprises a personal computer.

5. An imaging system module as claimed in claim 1 in which the layers of conducting material are formed of lead.

6. An imaging system module as claimed in claim 1 in which the anode comprises a series of mutually parallel conducting wires.

7. An imaging system module as claimed in claim 1 in which the converters comprise 50% or more of the thickness of the module.

8. An imaging system comprising a pair of detectors, each comprising a module as claimed in claim 1, wherein the detectors are positioned opposite each other so that a radiation source of which an image is to be formed can be positioned therebetween.

9. An imaging system as claimed in claim 8, wherein the system comprises a plurality of pairs of detectors, the pairs being angularly displaced from each other so as to form a polygonal arrangement of detectors about the radiation source.

10. An imaging system as claimed in claim 8, comprising rotation means for rotating the pair of detectors about the radiation source.

11. An imaging system as claimed in claim 8, in which each detector comprises a plurality of modules, wherein each module comprises a pair of high density avalanche chamber converters, each converter including a series of alternate layers of conducting and non-conducting material and an array of parallel, through-going apertures extending through said series of alternate layers, a first converter of the pair having a plurality of conducting elements extending generally parallel to each other in a first direction to form a first cathode on or adjacent to a face of the first converter and the second converter of the pair having a plurality of conducting elements extending generally parallel to each other in a direction generally orthogonal to the first direction to form a second cathode on or adjacent to a face of the second converter, and an anode formed by a series of generally parallel conducting elements positioned between the first and second cathodes, the arrangement being such that radiation incident upon either converter produces an avalanche of charged particles which are attracted towards the said anode and the incidence of a charged particle on the anode causes a current pulse in both the first and second cathodes.

12. Positron emission tomography apparatus incorporating one or more imaging system modules, wherein each module comprises a pair of high density avalanche chamber converters, each converter including a series of alternate layers of conducting and non-conducting material and an array of parallel, through-going apertures extending through said series of alternate layers, a first converter of the pair having a plurality of conducting elements extending generally parallel to each other in a first direction to form a first cathode on or adjacent to a face of the first converter and the second converter of the pair having a plurality of conducting elements extending generally parallel to each other in a direction generally orthogonal to the first direction to form a second cathode on or adjacent to a face of the second converter, and an anode formed by a series of generally parallel conducting elements positioned between the first and second cathodes, the arrangement being such that radiation incident upon either converter produces an avalanche of charged particles which are attracted towards the said anode and the incidence of a charged particle on the anode causes a current pulse in both the first and second cathodes, or wherein the imaging system comprises a pair of detectors, each comprising a module, wherein each module comprises a pair of high density avalanche chamber converters, each converter including a series of alternate layers of conducting and non-conducting material and an array of parallel, through-going apertures extending through said series of alternate layers, a first converter of the pair having a plurality of conducting elements extending generally parallel to each other in a first direction to form a first cathode on or adjacent to a face of the first converter and the second converter of the pair having a plurality of conducting elements extending generally parallel to each other in a direction generally orthogonal to the first direction to form a second cathode on or adjacent to a face of the second converter, and an anode formed by a series of generally parallel conducting elements positioned between the first and second cathodes, the arrangement being such that radiation incident upon either converter produces an avalanche of charged particles which are attracted towards the said anode and the incidence of a charged particle on the anode causes a current pulse in both the first and second cathodes, and wherein the detectors are positioned opposite each other so that a radiation source of which an image is to be formed can be positioned therebetween.

* * * * *